United States Patent [19]

Babb et al.

[11] 4,280,884

[45] Jul. 28, 1981

[54] METHOD AND APPARATUS FOR RECOVERY OF SILVER EMPLOYING AN ELECTROLYTIC CELL HAVING IMPROVED SOLUTION MOVEMENT

[75] Inventors: James H. Babb; Johnny C. Cox, both of Oliver Springs, Tenn.

[73] Assignee: Demco, Inc., Coalfield, Tenn.

[21] Appl. No.: 138,130

[22] Filed: Apr. 7, 1980

[51] Int. Cl.[3] ..... C25C 1/20

[52] U.S. Cl. ..... 204/109; 204/272; 204/275

[58] Field of Search ..... 204/109, 272, 275

[56] References Cited

U.S. PATENT DOCUMENTS

| | | | |
|---|---|---|---|
| 1,019,969 | 3/1912 | Lacroix . | |
| 1,159,699 | 11/1915 | Murdock . | |
| 3,282,823 | 11/1966 | Richards | 204/272 |
| 3,457,152 | 7/1969 | Maloney et al. | 204/131 |
| 3,503,856 | 3/1970 | Blackmore | 204/6 |
| 3,583,897 | 6/1971 | Fulweiler | 204/109 |
| 3,694,341 | 9/1972 | Luck | 204/273 |
| 3,926,768 | 12/1975 | Burgess | 204/229 |
| 4,026,784 | 5/1977 | Rivers | 204/273 |
| 4,028,212 | 6/1977 | Bowen et al. | 204/272 |

FOREIGN PATENT DOCUMENTS

| | | | |
|---|---|---|---|
| 835365 | 2/1970 | Canada | 204/109 |

*Primary Examiner*—Howard S. Williams

[57] ABSTRACT

A method and apparatus for recovery of metallic silver from a silver containing aqueous solution employing an electrolytic cell by introducing such solution to a hollow central anode and jetting the solution from the anode through a plurality of apertures having outwardly flared exit sections in generally conically configured streams from the anode toward an outer circumscribing cathode of the cell. The solution issuing forth simultaneously from the several apertures is moved in a plurality of streams toward the cathode, each stream diffusing as it nears the cathode.

4 Claims, 5 Drawing Figures

METHOD AND APPARATUS FOR RECOVERY OF SILVER EMPLOYING AN ELECTROLYTIC CELL HAVING IMPROVED SOLUTION MOVEMENT

This invention relates to the recovery of metallic silver from an aqueous solution containing silver ions, and particularly to electrolytic deposition of metallic silver from an aqueous solution containing silver ions.

The art is replete with discussions concerning the problem of recovering metallic silver from aqueous solutions, particularly those solutions employed in the development of X-ray film and the like, at times referred to as ("hypo").

The prior art methods and apparatus employed to recover such silver include various concepts for agitating the silver-containing solution within an electrolytic cell in an effort to enhance the efficiency of silver recovery by electrolytic deposition. For example, U.S. Pat. No. 3,694,341 refers to the use of an agitator in the bottom of the cell. U.S. Pat. No. 2,997,438 proposes placing an agitator in the top of the cell. In U.S. Pat. No. 4,026,784, there is disclosed the concept of directing the aqueous solution within the cell along a helical path which carries the solution adjacent to the cylindrical cathode. In U.S. Pat. No. 4,028,212, the aqueous solution is introduced into a central hollow anode and jetted therefrom along paths which cause the solution to swirl around the cell.

Each of these prior art devices offers a means for agitating the solution within the cell, but the present inventors have determined that each of these devices produces an activity within the electrolytic cell wherein the solution is generally moved as a body in a manner such that the desired substantial agitation of the solution is not accomplished. For example, in those devices wherein there are provided rotary agitators, the solution, after a relative short period of agitation, tends to swirl uniformly within the electrolytic cell as a whole. Substantially the same result is obtained in the swirling devices in U.S. Pat. Nos. 4,028,212 and 4,026,784.

In accordance with the present invention, the inventors have determined that recovery of metallic silver employing an electrolytic cell is enhanced by introducing the silver-containing aqueous solution to a hollow central anode and jetting the solution from the anode through a plurality of apertures having outwardly flared exit sections in generally conically configured streams from the anode toward the outer circumscribing cathode of the cell. In this manner the solution issuing forth simultaneously from the several apertures is moved in a plurality of streams toward the cathode, each stream diffusing as it nears the cathode. Further, the action of the several streams simultaneously striking the cathode and bouncing therefrom react with each other to develop substantial turbulance within the cell, particularly and desirably next to the cathode. In this manner, the solution is initially directed to the cathode and thereafter redirected several times to the cathode by the turbulance of the several jetting streams.

It is therefore an object of this invention to provide an improved method and apparatus for the recovery of metallic silver from an aqueous solution containing sliver ions. It is a further object to provide an apparatus for directing a plurality of streams of silver-containing solution toward a cathode in an electrolytic cell, wherein the streams interact with one another to generate turbulence of the solution within the cell in the region of the cathode.

Other objects and advantages of the invention will be recognized from the following description and claims, including the drawings in which:

Figure 1:
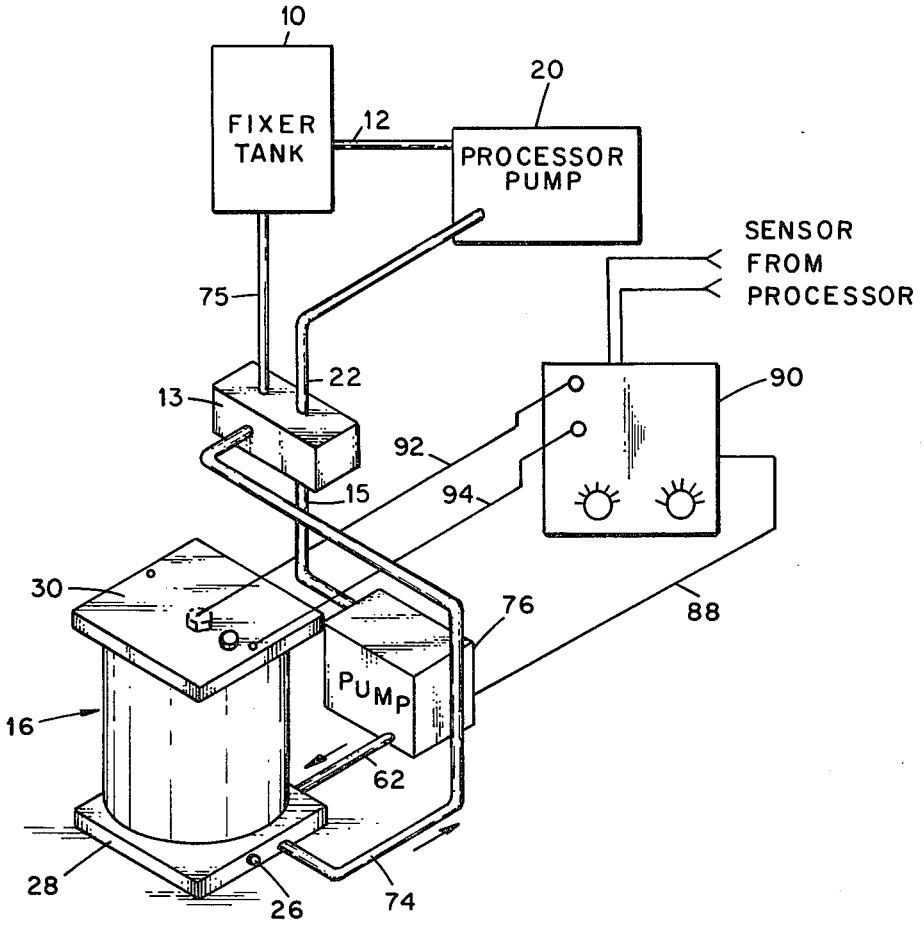
FIG. 1 is a representation of the system for recovering silver from an equeous solution containing silver ions and embodying various features of the invention.
Figure 2:
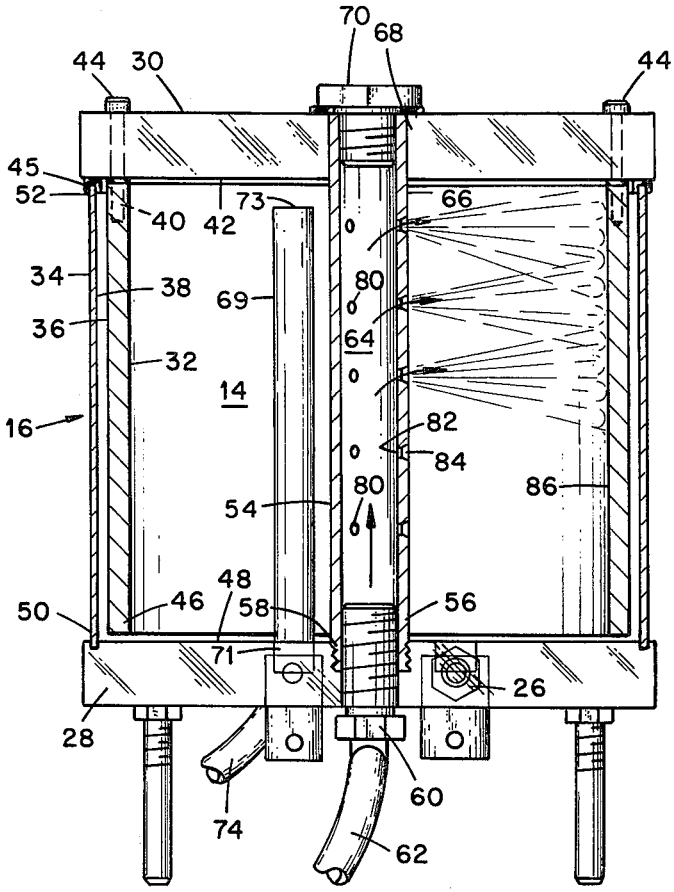
FIG. 2 is a sectional view of an electrolytic cell depicted in FIG. 1.

With reference to FIGS. 1 and 2, in accordance to the present disclosure an aqueous solution containing silver ions, such as the "hypo" solution from an X-ray film processor fixer tank 10 is conveyed through conduits 12, 22, 15 and 62 into the interior 14 of an electrolytic cell 16. A pump 76 and manifold 13 are interposed between the conduits 12 and 62 to control the flow of solution from the fixer tank into the electrolytic cell. As further viewed in FIG. 1, the interior of the electrolytic cell is also connected in fluid communication to the fixer tank 10 by means of further conduits 74 and 75. The manifold 13 is interposed between the conduits 74 and 75 to control the flow of solution through these conduits. By means of selective operation of the pump 76, silver-laden solution is conveyed from the fixer tank into the interior of the electrolytic cell and silver-depleted solution is removed from the cell and returned to the fixer tank. As desired, the electrolytic cell may be filled, carried through a recovery cycle or hypo may may be continuously pumped through the cell (when the processor is activated).

In the usual situation, however, in the course of operating the electrolytic cell, the solution is continually fed from the fixer tank into the electrolytic cell and back to the fixer tank, employing the processor pump as the primary means for moving the solution. This flow of solution is at a relatively slow rate which is calculated to permit the solution to remain in the area of electrolytic cell for a time sufficient to remove a substantial portion, or substantially all, of the silver therefrom. A drain plug 26 is provided in the bottom of the cell to permit complete emptying of the cell as desired.

Referring to FIG. 2, in a preferred embodiment, the present apparatus comprises an electrolytic cell 16 which includes a generally planar bottom plate 28 and a generally planar top plate 30. These top and bottom plates are of an acrylic plastic and are spaced apart and have interposed therebetween a right cylindrical smooth wall cylindrical cathode 32 of a material such as Type 316 stainless steel. In the depicted embodiment, the cell further includes an outer relatively thin-wall cylindrical shell 34 of an acrylic plastic which is also disposed between the top and bottom plates 28 and 30 and which is in concentric relationship to the cathode 32. As noted in FIG. 2, there is a slight clearance, e.g. about ⅛ inch, between the outer wall 36 of the cathode and the inner wall 38 of the shell 34.

The upper edge 40 of the cathode 32 is secured to the bottom surface 42 of the top plate 30 by means of a plurality of screws 44 (typical). It is to be noted from FIG. 2 that the bottom edge 46 of the cathode is spaced above the upper surface 48 of the bottom plate 28 of the cell. In this manner, the cathode is suspended from the top plate 30 so that when the top plate is removed, the cathode is simultaneously withdrawn from the cell. As indicated in FIG. 2, the outer shell 34 is permanently sealed in fluid tight engagement at its lowermost end 50 with the bottom plate 28. Preferably, a seal ring 45 is interposed between the top edge 52 of the shell 34 and the bottom surface 42 of the top plate 30 to prevent fluid leakage therebetween. By this means, the cathode which has deposited thereon a quantity of silver can be removed from the cell with the top plate 30, without draining the cell, thus expediting the recovery of the silver on a periodic basis.

Still referring to FIG. 2, there is provided in the depicted electrolytic cell 16 a central anode 54 of a material such as platinum-coated titanium. The depicted anode 54 comprises a hollow cylindrical tube which is threaded at its lower end 56 to be threadably received within a threaded opening 58 that passes through the thickness of the bottom plate 28. This opening 58 through the bottom plate 28 further receives therein a threaded fitting 60 to which there is attached the conduit 62 that leads in fluid communication through the fitting 60 to the interior 64 of the hollow anode 54. The upper end 66 of the anode is sealingly received through an opening 68 through the thickness of the top plate 30. This upper end of the anode is closed as by a threaded plug 70. The plug 70 provides the only means for securing the top plate 30 in position. Thus, when an operator desires to withdraw the cathode 32 for removal of silver, he merely removes the threaded plug 70 and then lifts off the top plate 30 and the cathode 32 which is attached by the screws 44.

Figure 3:
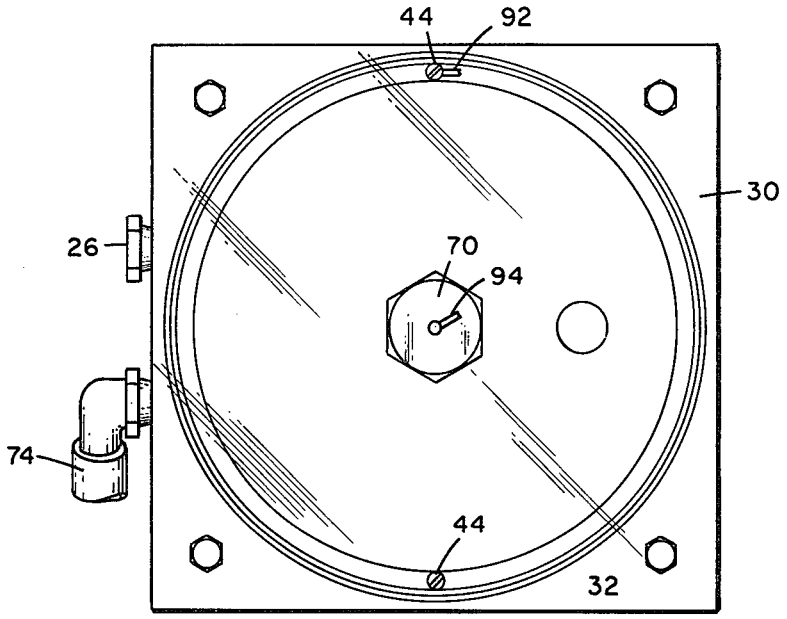
FIG. 3 is a top view of the electrolytic cell depicted in FIG. 1.
Figure 4:
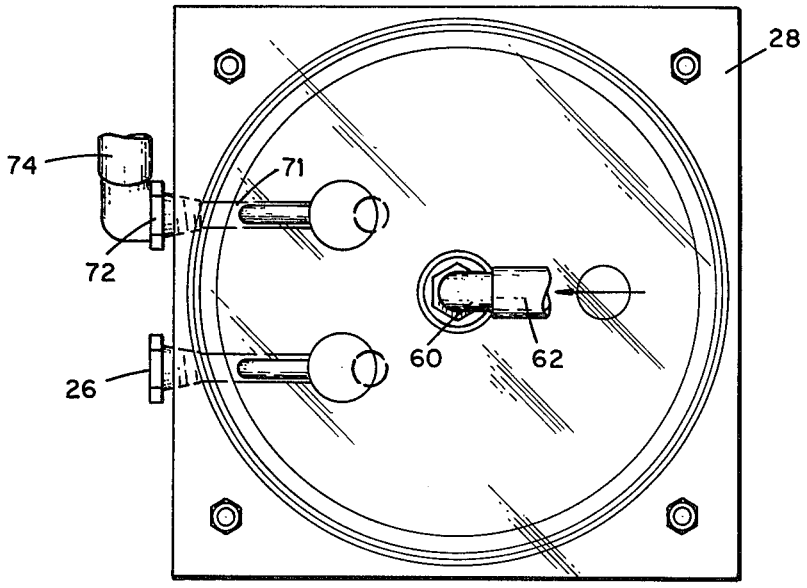
FIG. 4 is a bottom view of the electrolytic cell depicted in FIG. 1.

Referring to FIGS. 2, 3 and 4, it is noted that the bottom plate 28 of the cell 16 is provided with an elongated tube 69 which extends vertically from the plate 28 to a location adjacent to, yet spaced from, the top plate 30. The tube 69 is connected in fluid communication with an outlet passageway 71 which serves as a means through which solution may be withdrawn from the interior of the cell. This passageway 71 is provided with a fitting 72 to which there is attached the conduit 74 which leads from the cell to the manifold 13 (see FIG. 1). In this manner, there is provided means whereby solution may be withdrawn from the upper region of the interior 14 of the cell between the cathode and anode by the pump 20 and returned to the cell through the hollow anode 54.

With reference to FIG. 2, it will be noted that there is provided a plurality of openings 80 through the wall thickness of the hollow anode 54 at spaced apart horizontal levels along the length of the upright anode. Preferably, at each horizontal level, there is provided at least three such openings spaced 120° apart around the circumference of the anode.

Each of the openings through the wall thickness of the anode comprises two sections. The first section 82 of each opening is cylindrical with a straight wall about 0.062 inch in length and about 0.094 inch diameter. This provides a constant cross-section which transists into an outwardly flaring second section 84 of about 0.062 inch in length and having a taper of about 45°. Thus, as solution leaves the interior of the anode, it moves first through the straight bore section 82 of an opening 80 and then leaves the opening through the outwardly flared second section 84 thereof. This geometry of the opening provides for a slight diverging of a stream of solution as it moves from the anode toward the cathode so that the stream of liquid issuing forth from each opening is generally conical in geometry, with the apex of the conical geometry being adjacent the anode. The degree of taper of the flared section of the opening, among other things, affects the extent of dispersion of the stream of solution flowing through the opening and in a preferred embodiment, such taper is chosen to be between about 40 and 60° so as to maintain the flowing stream of solution reasonably coherent until it strikes the surface of the cathode, but not so coherent as prohibits substantial dispersion of the stream to effect relatively broad area coverage of the internal cathode surface 86 by the plurality of streams issuing forth from the anode. In one embodiment, the anode has about five inches of its length disposed within the interior of the cell. This anode has five horizontal levels of openings, each level being spaced about one inch from an adjacent level, with three openings per level spaced about 120° apart about the anode circumference, thereby providing a total of fifteen holes through the wall thickness of the anode. All of the openings are located below the upper edge 73 of the tube 69. Employing a pump which moves approximately 500–600 gallons per hour through the openings, it has been found that good dispersion of the streams is obtained at the surface of a cathode spaced about 2½ inches radially from the outer surface of the anode.

As shown in FIG. 1, the pump 76 is connected by an electrical lead 88 to a control 90. Further, the control panel is connected by electrical leads 92 and 94 to the anode 54 at the plug 70 and to the cathode 32 at the screw 44 to provide an electrolyzing current.

Figure 5:
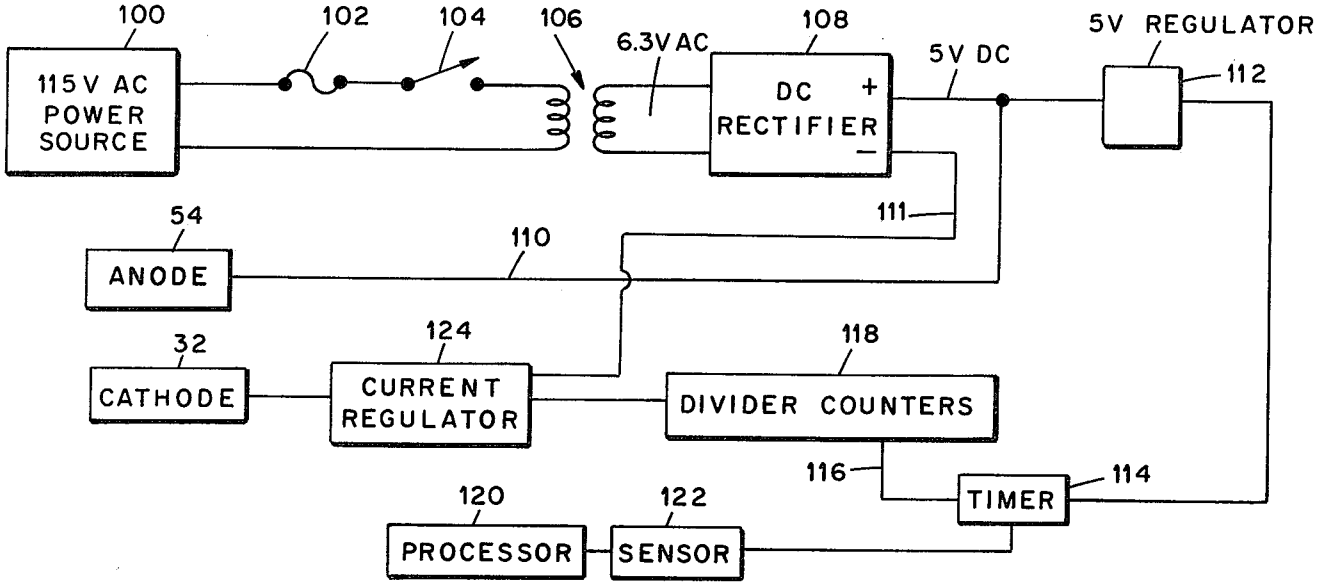
FIG. 5 is a schematic diagram depicting a control system for the silver recovery device shown in FIG. 1.

Referring now to FIG. 5, in one embodiment of a control system for the disclosed apparatus, there is provided a 115 volt A.C. power source 100 which is connected through a fuse 102 and a switch 104 to one side of a transformer 106. The opposite side of the transformer reduces the 115 volt A.C. current to about 6.3 volts A.C. This latter voltage output is fed through a D.C. rectifier 108 to provide a 5 volt D.C. output which is fed to the anode 54 as by electrical lead 110, fed to the cathode 32 as by electrical lead 111, and also fed through a 5 volt regulator 112 to a timer 114. The timer is further connected by an electrical lead 116 to a set of divider counters 118 which divide the pulses from the timer down to 1 per minute or 1 per each 11 minutes as is desired, thereby providing for adjustability of the desired time that current is applied to the cathode 32. The divider counters and their associated circuitry are preset to provide a constant ½ amp "idling" current to the cathode. This current is stepped up to 3 amps, for example, when the processor 120 is activated as by the introduction of an X-ray film into the processor. Such activation of the processor is sensed by a sensor circuit 122 to feed an electrical signal to the divider counters to increase the ½ amp current to 3 amps. This 3 amp current is fed through a current regulator 124 thence to the cathode 32. When the processor is inactive, the current returns to the ½ amp idle current. U.S. Pat. No. 4,026,784 issued May 31, 1977, discloses a further control circuit.

Whereas a specific embodiment has been described herein, it is intended to limit the invention only as set forth in the claims attached hereto.

What I claim:

1. A method for the recovery of metallic silver from a solution containing silver ions employing an electrolytic cell that includes a hollow anode disposed concentrically within a hollow cylindrical cathode comprising the steps of directing said solution into the interior of said hollow anode, ejecting said solution from said anode through a plurality of apertures through the wall thickness of said anode in a direction toward said cathode, each of said apertures having a divergent exit portion tapered at an angle of between about 40° and 60°, whereby the stream of solution ejected therethrough is of a diverging generally conical geometry.

2. The method of claim 1 including the step of withdrawing a portion of said solution from said cell in the region between said anode and said cathode and thereafter returning said withdrawn solution to the interior of said anode.

3. In an apparatus for recovery of metallic silver from a solution containing silver ions employing an electrolytic cell which includes a hollow anode disposed concentrically within a hollow cylindrical cathode the improvement comprising a plurality of openings through the wall of said anode, each of said openings having an outwardly flared exit section tapered at an angle of between about 40° and 60°, means withdrawing a portion of said solution from the region between said anode and said cathode and returning said withdrawn solution to the interior of said anode under a pressure sufficient to force said solution from said anode through each of said openings in a direction toward said cathode.

4. The apparatus of claim 3 wherein each of said openings includes a first section having a constant circular cross-section and a second section which is a continuation of said first section and which flares outwardly from said first section in a direction toward said cathode.

* * * * *